US005299805A

United States Patent [19]

Green

[11] Patent Number: 5,299,805

[45] Date of Patent: Apr. 5, 1994

[54] MULTILAYER PUZZLE

[76] Inventor: Dror Green, 37 Ben-Maimon Avenue, Jerusalem, Israel

[21] Appl. No.: 824,324

[22] Filed: Jan. 23, 1992

[30] Foreign Application Priority Data

Jan. 24, 1991 [IL] Israel ..... 97029

[51] Int. Cl.[5] ..... A63F 1/02

[52] U.S. Cl. ..... 273/157 A; 273/157 R

[58] Field of Search ..... 273/157 R, 157 A, 293

[56] References Cited

U.S. PATENT DOCUMENTS

| | | | |
|---|---|---|---|
| 1,948,962 | 2/1934 | Decker | 273/157 R |
| 2,149,779 | 3/1939 | Kroner | 273/157 A |
| 2,911,220 | 11/1959 | Irwin | 273/293 |
| 3,016,243 | 1/1962 | Irwin | 273/293 |
| 3,245,687 | 4/1966 | Irwin | 273/293 |
| 3,645,534 | 2/1972 | Weisbecker | 273/157 A |
| 4,362,301 | 12/1982 | Duveyoung | 273/157 A |
| 4,781,381 | 11/1988 | hein | 273/157 A |
| 4,815,742 | 3/1989 | Augustine | 273/157 A |
| 5,037,110 | 8/1991 | Haskel | 273/157 A |

FOREIGN PATENT DOCUMENTS

| | | | |
|---|---|---|---|
| 976961 | 12/1964 | United Kingdom | 273/157 A |

*Primary Examiner*—Vincent Millin
*Assistant Examiner*—Steven B. Wong
*Attorney, Agent, or Firm*—McAulay Fisher Nissen Goldberg & Kiel

[57] ABSTRACT

A multilayer puzzle having a plurality of superposable card units in the form of polygons of identical shape and size consisting of a transparent material. Surfaces of the card units carry a plurality of distinct markings in the form of layers of various, opaque colors disposed on at least portions of at least one of the surfaces of each of the card units, leaving transparent other surface portions thereof. Through which transparent surface portions there can be perceived surface portions of at least the next-lower card unit of the plurality of card units when superposed, whereby by rotation and/or face reversal of at least one of the card units in the superposed plurality, a large number of pattern-forming combinations of the markings can be obtained, differing in colors, shapes and relative positions. At least one of the combinations on at least one face of the superposed plurality of card units may be defined as target combination to be achieved by the handler of the puzzle.

7 Claims, 4 Drawing Sheets

MULTILAYER PUZZLE

The present invention relates to a multilayer puzzle, more particularly to a puzzle which is solved by stacking or superposition, rather than by juxtaposition, of puzzle units.

Puzzles of the juxtaposition type are known and include the jigsaw puzzle, in which the player is somewhat helped by the particular outlines of the pieces, which predetermine the mutual orientation thereof and the wooden cube puzzle, now largely displaced by the cardboard jigsaw puzzle, in which each cube carries on each of its six faces fragments of six different pictures. A category by itself is perhaps Rubik's Magic Cube which, however, is also of the juxtaposition type, as the final aim of the game is to produce a cube of six solid-colored faces, each composed of the co-planar, juxtaposed faces of identical color of the "cubies" making up the Cube.

It is one of the objects of the present invention to provide a puzzle that poses a greater intellectual challenge than does even the 500-piece jigsaw puzzle, yet has less than the $4\times10^{19}$ possible rearrangements of the Magic Cube, and is far less expensive than both. Also, it does not take up space and is easily carried in an inside pocket of one's jacket.

According to the invention, this is achieved by providing a multilayer puzzle comprising a plurality of superposable card units in the form of polygons of identical shape and size consisting of a transparent material, surfaces of which card units carry a plurality of distinct markings in the form of layers of various, opaque colors disposed on at least portions of at least one of the surfaces of each of said card units, leaving transparent other surface portions thereof, through which transparent surface portions there can be perceived surface portions of at least the next-lower card unit of said plurality of card units when superposed, whereby by rotation and/or face reversal of at least one of said card units in said superposed plurality, a large number of pattern-forming combinations of said markings can be obtained, differing in colors, shapes and relative positions, at least one of which combinations on at least one face of said superposed plurality of card units may be defined as target combination to be achieved by the handler of said puzzle.

The invention further provides a multilayer puzzle comprising a plurality of superposable card units in the form of polygons of identical shape and size consisting of a transparent material, each card unit carrying at least one fragment of an insignia, whereby by rotation and/or face reversal of said plurality of card units, when congruently superposed, the complete insignia will become apparent.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIGS. 1*a* to 1*d* illustrate the front faces of the four card units of a preferred embodiment of the puzzle according to the invention;

FIGS. 2*a* to 2*d* show the rear faces of these cards;

Figure 5:
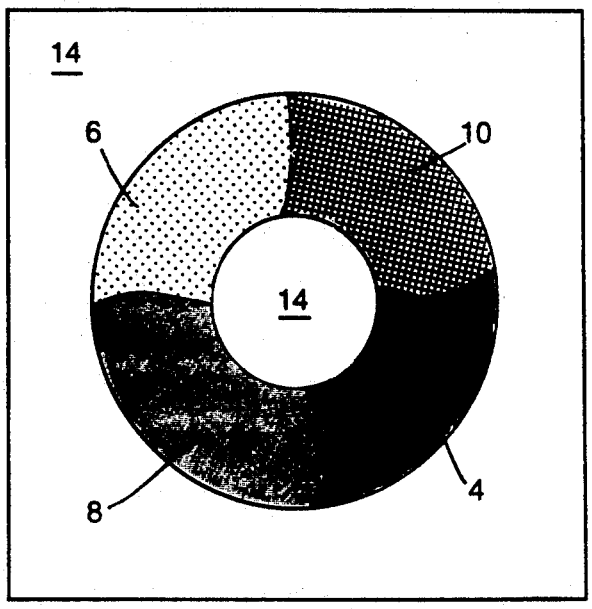
FIG. 5 represents the front face of another embodiment of a correctly stacked four card unit puzzle.
Figure 6A:
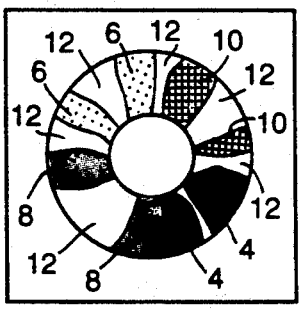
Figure 6B:
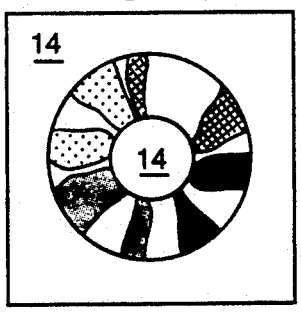
Figure 6C:
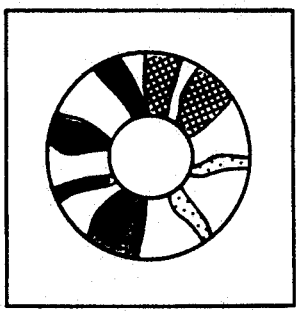
Figure 6D:
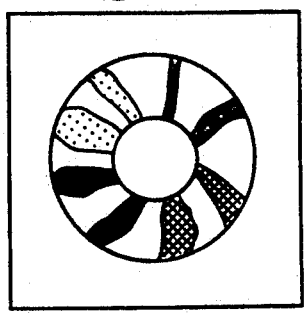
Figure 7A:
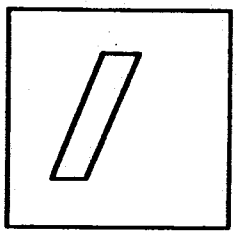
Figure 7B:
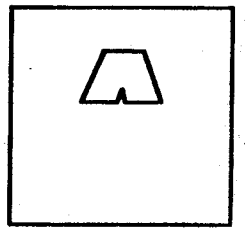
Figure 7C:
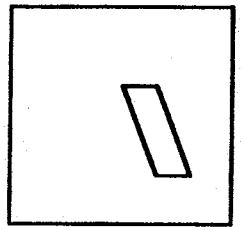
Figure 7D:
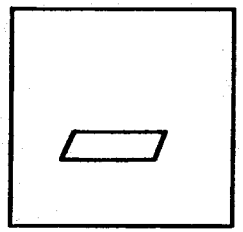
Figure 8:
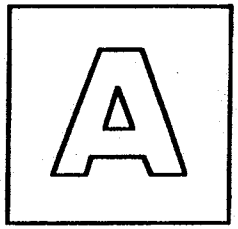
Figure 9A:
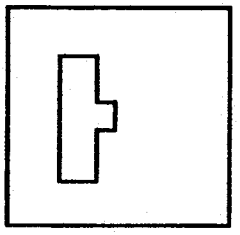
Figure 9B:
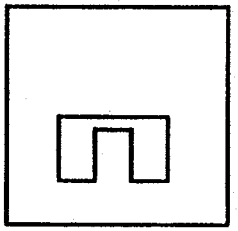
Figure 9C:
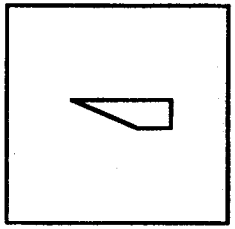
Figure 9D:
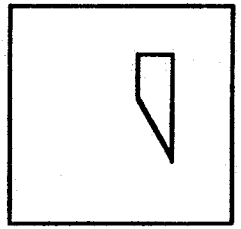

FIGS. 6*a* to 6*d* show the front faces of the card units of the puzzle of FIG. 5;

FIGS. 7*a* to 7*d* represent an example of the card units of yet another embodiment of the puzzle;

FIG. 8 shows the result of correct stacking of the card units of FIGS. 7*a* to 7*d;*

FIGS. 9*a* to 9*d* show another set of card units, and

Figure 10:
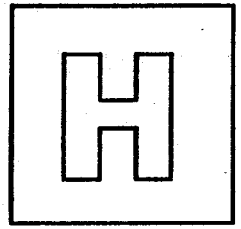

FIG. 10 shows the result of correct stacking of the card units of FIGS. 9*a* to 9*d.*

Referring now to the drawings, there are seen in FIGS. 1*a* to 1*d* four square-shaped card units 2 of identical size, each consisting of a square piece of a transparent material such as, advantageously, a plastic material. Further seen are a number of markings 4,6,8 and 10 in the form of layers of different, opaque colors applied to portions of the surface of the card units. The drawings being of necessity of the black-and-white type, these colors are represented by different shadings. The "white" areas or windows 12, on the other hand, are colorless, in fact transparent.

In this preferred embodiment of the invention, the rear face of the card units, too, is provided with markings of opaque color on the one hand, and with transparent windows 12, on the other, with the respective arrangements not necessarily similar, or even related, to the arrangement on the front face (for convenience, the card faces shown in FIGS. 1*a* to 1*d* will be designated "front faces" and the card faces shown in FIGS. 2*a* to 2*d*, "rear faces).

Figure 3:
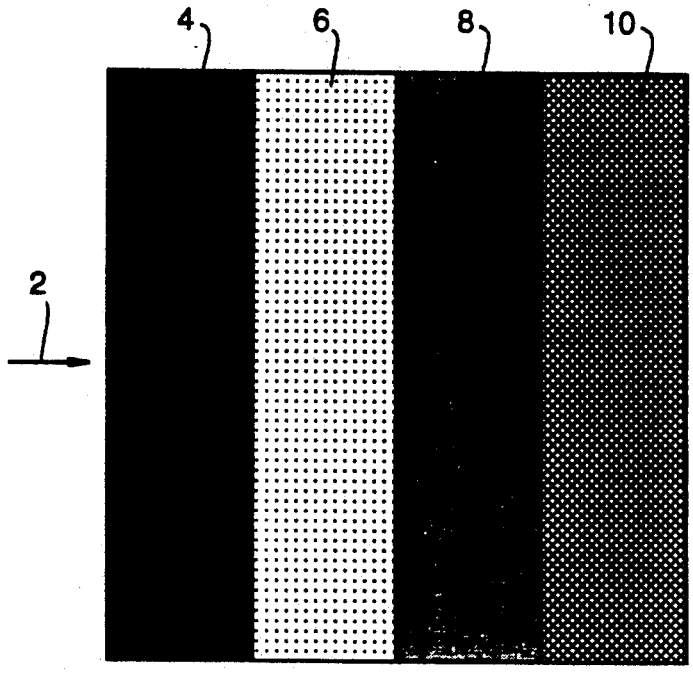
FIG. 3 shows the front face of the correctly stacked card units.

When now the card units are stacked one upon the other, the colored markings of the uppermost card will combine with colored markings of card units lower in the stack as seen through the transparent areas of card units higher up in the stack, to produce pattern-forming combinations, some of the more characteristic ones of which may be preselected as target combinations to be aimed at by the user of the puzzle, achievable by rotation and/or face reversal and/or change of location within the stack, of the card units. An example of such a target combination is shown in FIG. 3. When the card units shown in FIGS. 1*a* to 1*d* are congruently stacked following the sequence: 1*a* (top card)-1*b*-1*c*-1*d* (bottom card), as well as in the relative orientations indicated in FIGS. 1*a* to 1*d*, the resulting pattern will be as seen in FIG. 3, namely, a sequence of vertical, colored stripes.

Figure 1A:
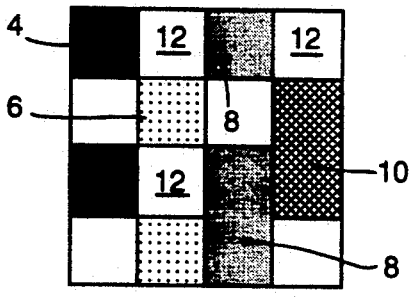
Figure 1B:
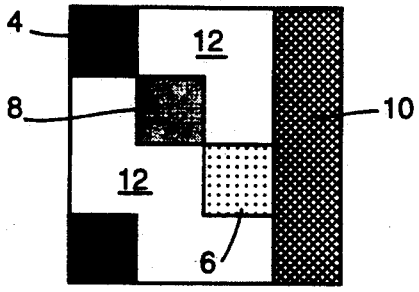
Figure 1C:
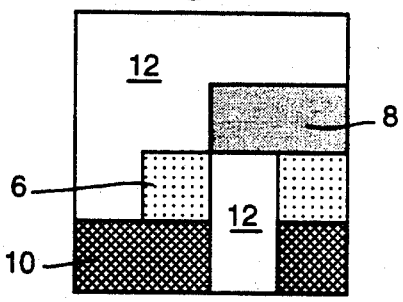
Figure 1D:
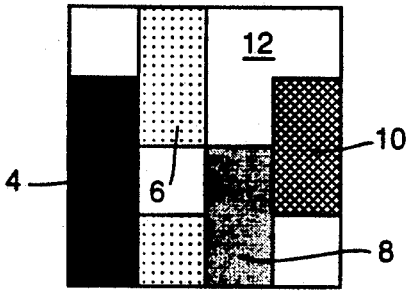
Figure 2A:
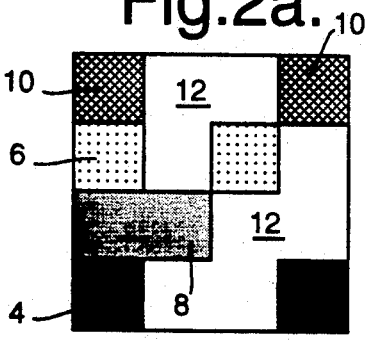
Figure 2B:
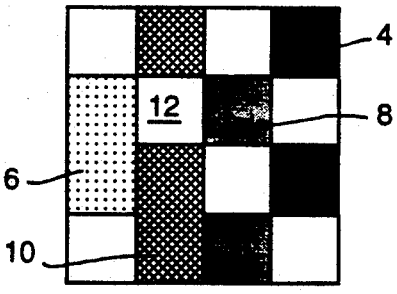
Figure 2C:
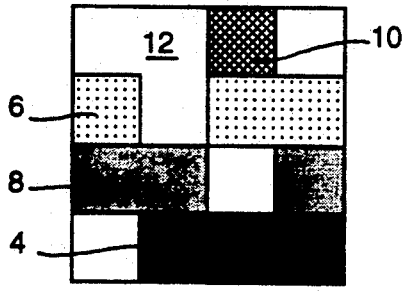
Figure 2D:
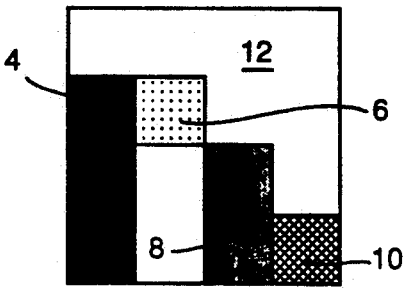

A second solution is possible when the card unit shown in FIG. 2*c* is selected as top card, to be followed by the cards of FIGS. 2*d*, 2*a* and 2*b* (bottom card), again keeping to the orientations indicated in FIGS. 2*a* to 2*d*. The result is shown in FIG. 4, namely, a sequence of colored stripes, this time, however, horizontally oriented.

Figure 4:
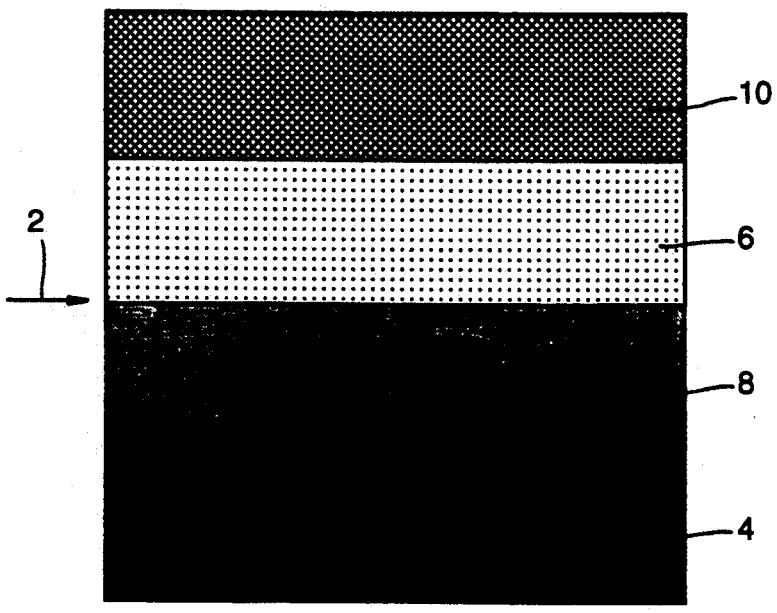
FIG. 4 shows the rear face of the correctly stacked card units.

If either one of the two above stacking sequences is followed, both results are achieved at the same time, that is, when the top face of the stack assumes the aspect of FIG. 3, the bottom face looks as shown in FIG. 4, and vice versa. However, there exist stacking sequences, easier to discover, whereby the target combination is established on one face of the stack only.

While in the above-discussed embodiment, the aspect of a target combination extended over the entire surface of the card unit and the colored markings 4,6,8 and 10, as well as the transparent windows 12 were all polygons, this is not a necessary condition of the puzzle according to the invention.

FIG. 5 represents a correctly stacked four-card puzzle in which the card units themselves are squares, but the aspect of the target combination is annular, with the borderline between the different colors being irregular. It is seen that the area 14 beyond, as well as inside, the annular shape is vacant and can be either transparent or of an opaque white. The card units making up the stack are shown in FIGS. 6*a* to 6*d*. It can be seen that the colored markings 4,6,8, and 10 are of a totally irregular shape, and so are, naturally, the windows 12. The card units 2 of this embodiment, too, can be double-sided.

Another embodiment of the puzzle according to the invention is illustrated in FIGS. 7*a* to 10. This embodiment is mainly intended as an educational toy for younger children and consists of a set of, e.g., four transparent card units 2 (FIGS. 7*a* to 7*d*), each carrying at least one fragment of a graphic symbol such as a letter which appears in its totality when the four card units are congruently stacked, with the symbol fragments of each card unit in correct orientation relative to those of the other three card units. Thus, the card units shown in FIGS. 7*a* to 7*d*, when correctly stacked, produce the letter A, as seen in FIG. 8, while the card units shown in FIGS. 9*a* to 9*d* produce the letter H of FIG. 10. In order not to make the proper choice too obvious, the different fragments, when stacked, may partly overlap. Thus the crossbar of the letter H in FIG. 9*c* is given a redundant feature in the form of a pointed end which, upon stacking, overlaps with the upright and stub crossbar of FIG. 9*a*.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

what is claimed is:

1. A multilayer puzzle comprising a plurality of superposable card units each in the form of regular polygons of identical shape and size consisting of a transparent material, said card units, when superposed, forming a stack having an upper, fist, face and an opposite, second face, surfaces of which card units carry a plurality of distinct markings in the form of layers of various, opaque colors perceived on at least portions of each of the surfaces of each of said card units, leaving transparent other surface portions thereof, through which transparent surface portions there can be perceived surface portions of at least the next-lower card unit of said stack, whereby rotation and/or face reversal and/or change of location, within said stack, of at least one of said card units in said stack, a large number of pattern-forming combinations of said markings can be obtained on both of said stack faces, differing in colors, shapes and relative positions, at least one of which combinations on at least one of said stack faces may be defined as target combination to be achieved by the handler of said puzzle.

2. The puzzle as claimed in claim 1, wherein said markings are polygonal.

3. The puzzle as claimed in claim 1, wherein said markings are of irregular shape.

4. The puzzle as claimed in claim 1, wherein a target combination on one face of said superposed plurality of card units also simultaneously produces a target combination in another opposite face thereof.

5. The puzzle as claimed in claim 1, wherein said identically shaped and sized polygons are aligned with each other so that edges of said card units when superposed are aligned with each other when said at least one target combination is achieved by the handler of said puzzle.

6. The puzzle as claimed in claim 1, wherein said card units are to be stacked by the handler in a predetermined order to form said stack to achieve said at least one target combination.

7. The puzzle as claimed in claim 6, wherein, in one predetermined order, said predetermined order requires achievement of said target combination on both of said stack faces simultaneously.

* * * * *